US006681435B2

(12) United States Patent
Wang

(10) Patent No.: US 6,681,435 B2
(45) Date of Patent: Jan. 27, 2004

(54) HAIRBRUSH HEAD

(75) Inventor: Tso Min Wang, Taipei Hsien (TW)

(73) Assignee: Gim-Hwa Enterprise Co., Ltd., Taipei Hsien (TW)

( * ) Notice: Subject to any disclaimer, the term of this patent is extended or adjusted under 35 U.S.C. 154(b) by 212 days.

(21) Appl. No.: 09/962,104

(22) Filed: Sep. 26, 2001

(65) Prior Publication Data

US 2003/0056310 A1 Mar. 27, 2003

(51) Int. Cl.[7] ..... A46B 3/00; A46D 24/16; A45D 6/00

(52) U.S. Cl. ..... 15/160; 15/159.1; 132/120; 132/228

(58) Field of Search ..... 15/159.1, 160, 15/186, 201; 132/120, 228

(56) References Cited

U.S. PATENT DOCUMENTS 3,843,990 A * 10/1974 Lardenois ..... 15/159.1
4,023,578 A * 5/1977 Buhler ..... 132/271
4,167,192 A * 9/1979 Arnold ..... 132/212
5,365,880 A * 11/1994 South ..... 119/602
5,887,600 A * 3/1999 Wilk ..... 132/262
5,911,226 A * 6/1999 Vecchiola et al. ..... 132/211
5,979,463 A * 11/1999 Santy et al. ..... 132/120
D430,348 S * 8/2000 Moreno ..... D28/18

* cited by examiner

*Primary Examiner*—Robert J. Warden, Sr.
*Assistant Examiner*—Laura C Cole
(74) *Attorney, Agent, or Firm*—Rabin & Berdo, P.C.

(57) ABSTRACT

A hairbrush head is connected to a front end of a handle and includes a solid cylindrical body having a bristle holder made of metal sheet attached to a circumferential surface thereof. The hairbrush head is so shaped that a space is provided between the circumferential surface of the cylindrical body and the bristle holder, so that hot air from a hairdryer passes through holes provided on the bristle holder into the space to circulate therein and thereby evenly distributes heat over the hairbrush head to facilitate easy hair setting.

5 Claims, 3 Drawing Sheets

HAIRBRUSH HEAD

FIELD OF THE INVENTION

The present invention relates to a hairbrush head, and more particularly to a hairbrush head being provided on a circumferential surface with a space into which hot air from a hairdryer enters to circulate and evenly distribute heat over the hairbrush head to facilitate easy hair setting.

BACKGROUND OF THE INVENTION

A hairbrush typically includes a head having a plurality of tufts of bristles implanted on a circumferential surface thereof. For those who are good at hair setting with hairbrush and hairdryer, the conventionally structured hairbrush head does not enable effective and easy hair setting because its design does not take airflow into consideration.

Among the commercially available hair setting means, there are hairbrushes having a hollow tubular head. Apart from a plurality of tufts of bristles implanted thereon, the hollow tubular head is also provided at its wall with through holes. A hairdresser may use one hand to turn the tubular head curling a volume of hair while manipulating a hairdryer with another hand to blow hot air toward the hair on the hairbrush head, so that hot air flows into the hollow tubular head via the through holes. However, the through holes provided on the hollow tubular head also enable hot air to easily flow out of the hairbrush head. That is, the hot air from the hairdryer does not circulate in the hollow tubular hairbrush head to facilitate effective and easy hair setting.

It is therefore desirable to develop a hairbrush head that enables good circulation of hot air therein to facilitate effective and easy hair setting.

SUMMARY OF THE INVENTION

A primary object of the present invention is to provide a hairbrush head having a space provided thereon to allow good circulation of hot air in the hairbrush head.

To achieve the above and other objects, the hairbrush head of the present invention mainly includes a solid cylindrical body having a bristle holder made of metal sheet attached to a circumferential surface thereof. The solid cylindrical body is so shaped that a space is provided between the circumferential surface of the cylindrical body and the bristle holder, so that hot air from a hairdryer passes through holes provided on the bristle holder into the space to circulate therein and thereby evenly distributes heat over the hairbrush head to facilitate easy hair setting.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
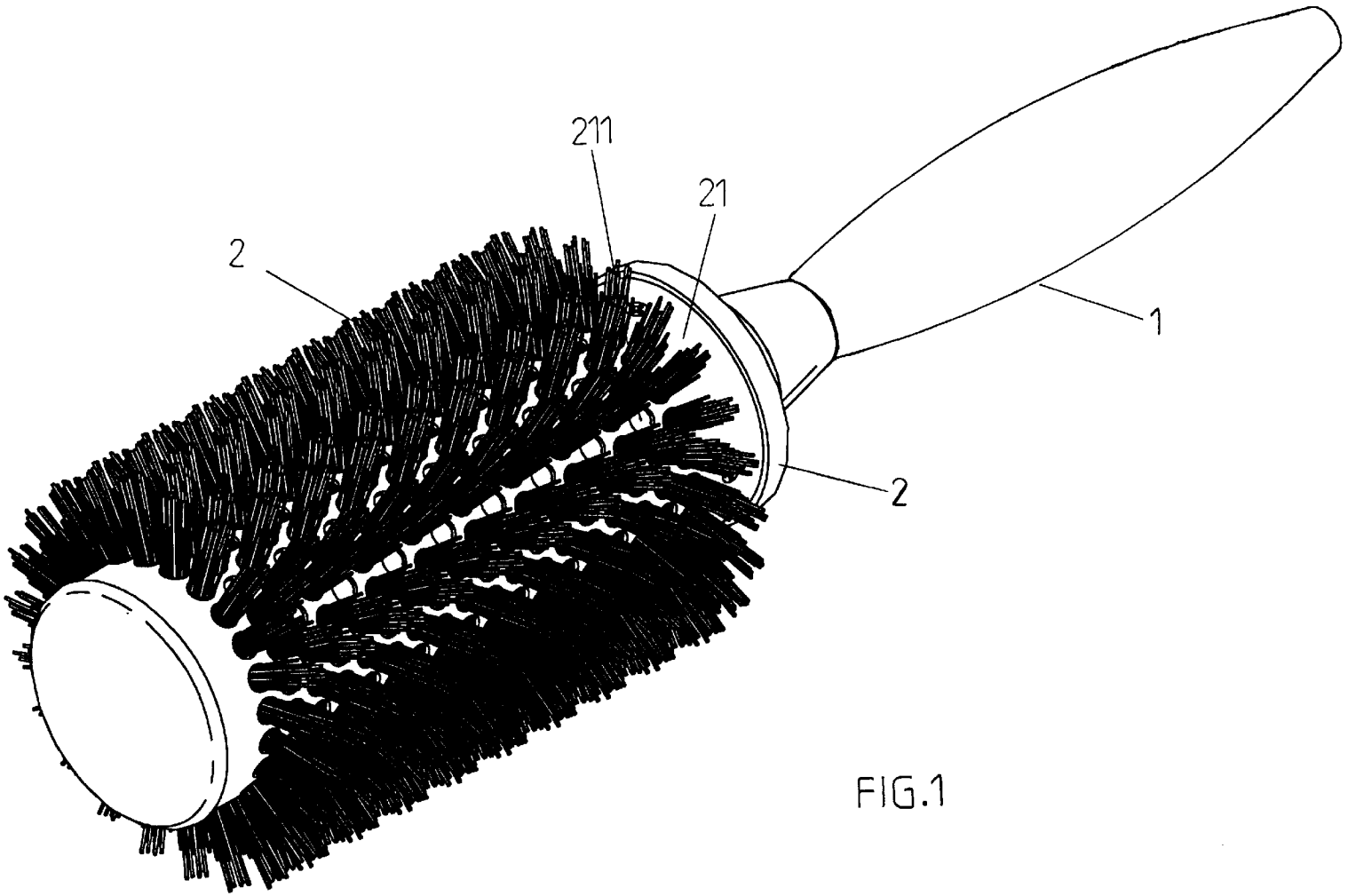
FIG. 1 is a perspective view of a hairbrush head according to the present invention.
Figure 2:
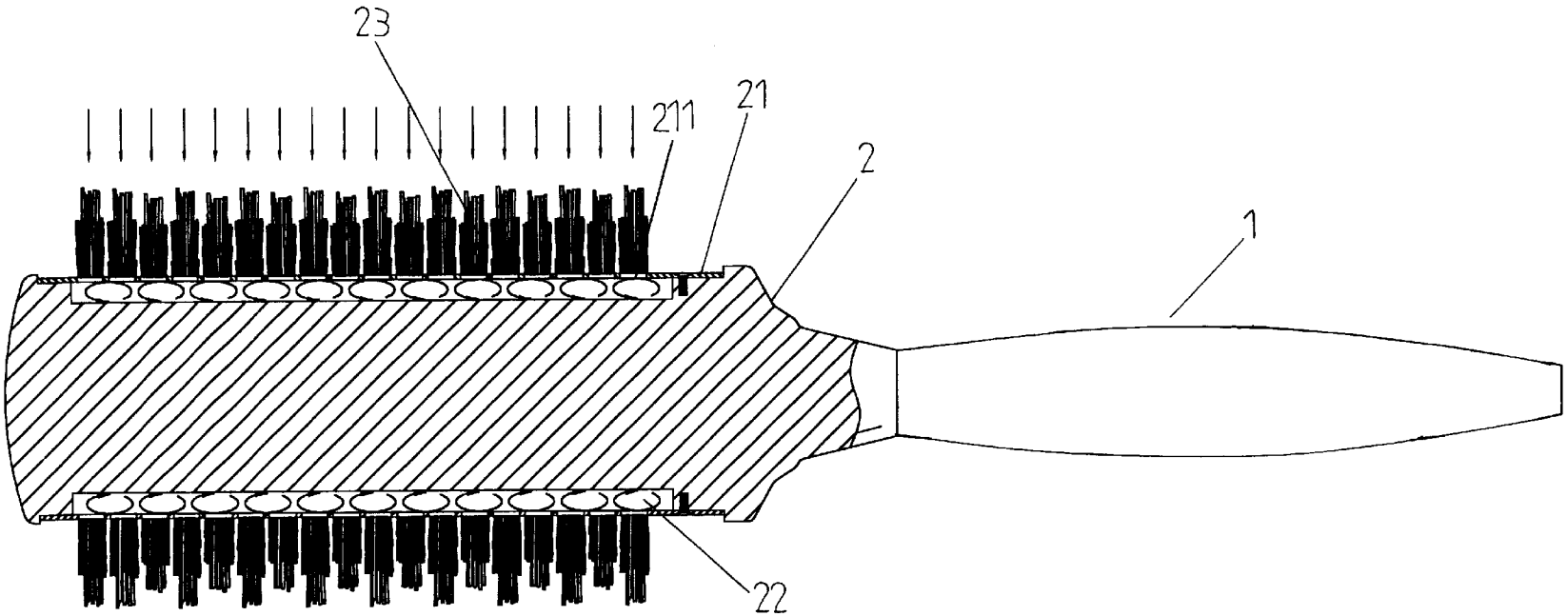
FIG. 2 is sectioned side view of FIG. 1.

Please refer to FIGS. 1 and 2 that are perspective and sectioned side views, respectively, of a hairbrush head 2 according to the present invention. As shown, the hairbrush head 2 is connected to a front end of a handle 1 that shows a smooth curve suitable for grip by a user.

The hairbrush head 2 includes a solid cylindrical body having an annular recess. In a preferred embodiment of the present invention, the solid cylindrical body of the hairbrush head 2 is made of a wooden material. A bristle holder 21 in sheet form is fixed around a circumferential surface of the cylindrical body of the hairbrush head 2. A rear edge of the bristle holder 21 adjacent to the handle 1 is firmly fastened to the cylindrical body by means of screws. The cylindrical body is so shaped that a space 22 exists between the circumferential surface of the cylindrical body (i.e. a bottom of the recess) and the bristle holder 21 fixed around the cylindrical body. The bristle holder 21 is provided with a plurality of through holes 211. Tufts of long and short bristles 23 are implanted into some of the through holes 211 to radially project from the hairbrush head 2. In the preferred embodiment of the present invention, the bristle holder 21 is made of a metal material, such as aluminum sheet, so as to provide good heat conduction effect.

Figure 3:
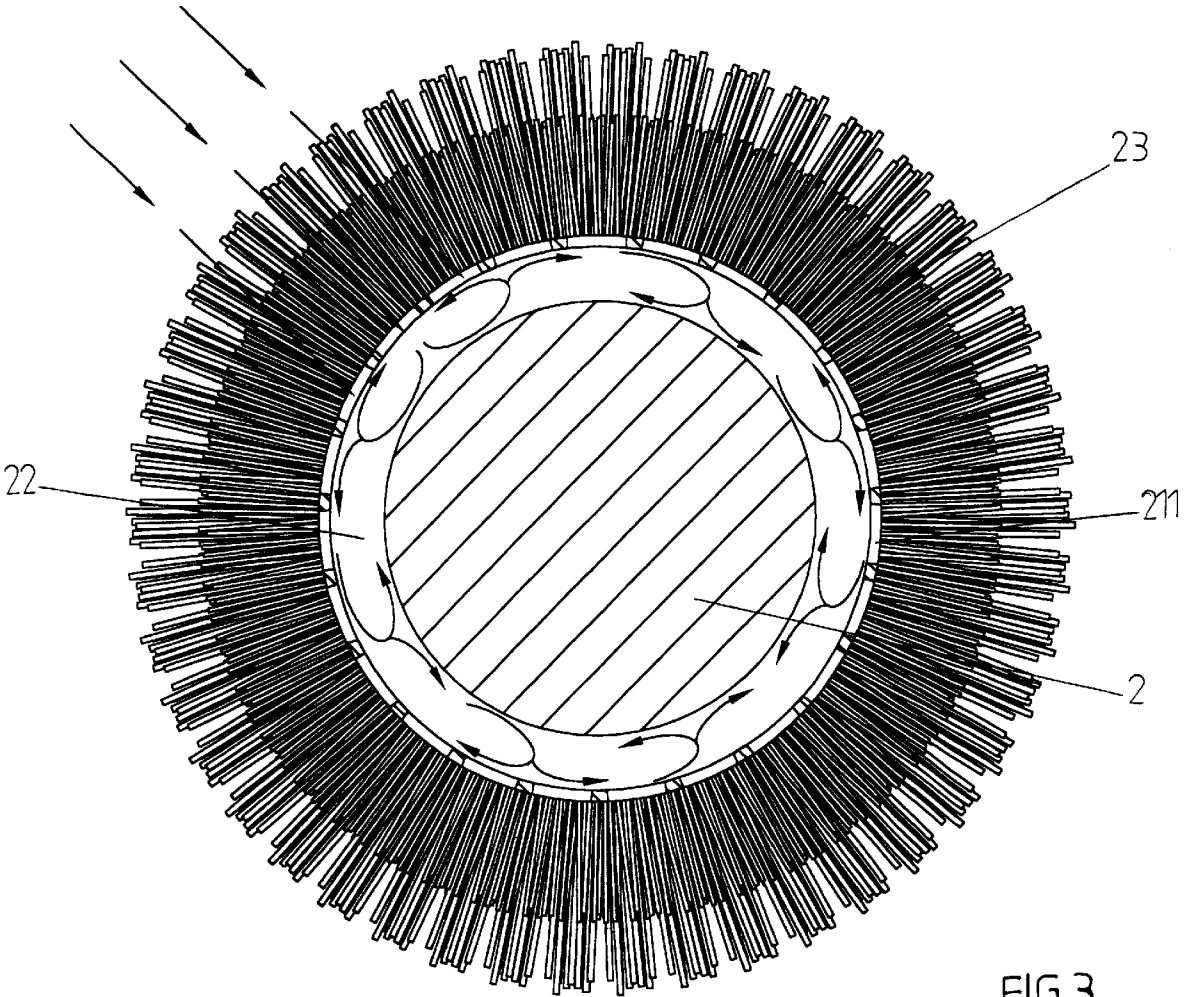
FIG. 3 is a cross sectional view of the hairbrush head according to the present invention.

Please refer to FIG. 3 that is a cross sectional view of the hairbrush head 2. When the hairbrush head 2 of the present invention is used in hair setting and hot air is blown from a hairdryer (not shown) toward the hairbrush head 2 in a direction indicated by arrows at upper left corner of FIG. 3, the hot air will flow into the space 22 via the a plurality of through holes 211 to circulate in the space 22 between the cylindrical body of the hairbrush head 2 and the metal bristle holder 21, so as to evenly distribute heat over the hairbrush head 2. Since the bristle holder 21 is made of a metal material, such as aluminum sheet, it provides very good heat conduction effect, enabling a hairdresser to set hairs easier with the help of the hot air circulating in the space 22.

With the space 22 provided around the hairbrush head 2 and the through holes 211 provided on the bristle holder 21, hot air is admitted into the space 22 via the through holes 211 to circulate in the space 22 and evenly heat the bristle holder 21 and accordingly the entire hairbrush head 2. For hairdressers or general consumers who frequently use a hairdryer to set hairs, the hairbrush head 2 of the present invention is more practical and effective for use, as compared with conventional hairbrush heads.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A hairbrush head, comprising:

a body having an annular recess formed therein, a bottom of the recess being essentially smooth and free of perforations;

a plurality of bristles; and a bristle holder attached to said body and covering the annular recess, said bristle holder and the annular recess forming a space, said bristle holder having a plurality of through holes that are in communication with the space, with a first group of the through holes having tufts of said bristles implanted therein, with the bristles terminating in a region of said bristle holder so that the space is free of said bristles, and with a second group of the through holes being free of said bristles to allow hot air from a hairdryer to enter the space therethrough, whereby a circulation and even distribution of the hot air in the space is facilitated.

2. The hairbrush head recited in claim 1, wherein said bristle holder is comprised of metal.

3. The hairbrush head recited in claim 1, wherein said body is a solid, and has a cylindrical shape, said bristle holder being attached to a circumferential surface of said body.

4. The hairbrush head recited in claim 1, further comprising a handle connected to said body.

5. The hairbrush head recited in claim 1, wherein said bristle holder is comprised of metal, and said body is comprised of wood.

* * * * *